United States Patent [19]

Lovell, Sr. et al.

[11] Patent Number: 5,011,157

[45] Date of Patent: Apr. 30, 1991

[54] ELECTRONIC GAME DISPLAY DEVICE

[75] Inventors: John G. Lovell, Sr., Knoxville; Garry W. Owens, Morristown, both of Tenn.

[73] Assignee: Bonus Games, Knoxville, Tenn.

[21] Appl. No.: 490,293

[22] Filed: Mar. 8, 1990

[51] Int. Cl.[5] ..... A63F 3/06

[52] U.S. Cl. ..... 273/238; 273/269; 273/138 A; 273/144 R

[58] Field of Search ..... 273/144 R, 144 A, 144 B, 273/237, 238, 138 A, 269

[56] References Cited

U.S. PATENT DOCUMENTS

| | | | |
|---|---|---|---|
| 2,591,869 | 4/1952 | Quimby | 273/238 |
| 2,760,619 | 8/1956 | Peak | 273/238 X |
| 3,118,677 | 1/1964 | Lang | 273/144 R |
| 3,271,529 | 9/1966 | Pawelka | 273/238 X |
| 3,300,217 | 1/1967 | Franklin | 273/238 |
| 3,810,629 | 5/1974 | Yamamoto | 273/144 A |
| 4,218,063 | 8/1980 | Cooper et al. | 273/237 |
| 4,274,638 | 6/1981 | Jullien | 273/238 |
| 4,312,511 | 1/1982 | Jullien | 273/237 |
| 4,332,389 | 6/1982 | Loyd, Jr. et al. | 273/237 |

*Primary Examiner*—William H. Grieb

*Attorney, Agent, or Firm*—Pitts and Brittian

[57] ABSTRACT

An electronic alpha-numeric digit displaying device, together with a control unit and electronic circuitry appropriate to the encoding, sending, receiving, decoding, and displaying of data as used in various games, such as Bingo, Keno, or the like, in which a plurality of players may participate. In the exemplary game of Bingo, for instance, light-weight plastic balls, each marked with a letter and a number, are randomly selected and deposited into apertures in a console, by which action they are automatically identified through the breaking of one row and one column infra-red light beam of a coordinate grid of such beams. Through electronic encoding, transmitting/receiving, and decoding, the aforesaid letter-number combination is substantially instantaneously displayed in two places on a display board. One of these locations is on letter-labeled rows by the sequential order of the selected letter-number; the other location is on a separate row where appearance is determined entirely by the sequence in which the letter-number combination is selected. The numbers are continuously selected and progressively displayed until a round of play has been completed in accordance with various rules of the game being played. When this occurs, the display board is cleared and all of the balls are reloaded to begin the next round of play. The console contains manually operated controls which affect the game data stored in memory and thus the display board, also.

20 Claims, 11 Drawing Sheets

| DEC. | HEX. $ | BCD | PULSE TRAINS (1=PULSE) 40 42 | DISPLAY | PULSE TRAINS (1=PULSE) 40 42 | DISPLAY | PULSE TRAINS 0=NO PULSE X=NO PULSE 40 42 | DISPLAY | PULSE TRAINS 40 42 | DISPLAY | PULSE TRAINS 40 42 | DISPLAY |
|---|---|---|---|---|---|---|---|---|---|---|---|---|
| 0 | 0 | 0000 | B | | I | | N | | G | | O | |
| 1 | 1 | 0001 | 0001X0001 | =B01 | 0010X0001 | =I16 | 0011X0001 | =N31 | 0100X0001 | =G46 | 0101X0001 | =O61 |
| 2 | 2 | 0010 | 0001X0010 | =B02 | 0010X0010 | =I17 | 0011X0010 | =N32 | 0100X0010 | =G47 | 0101X0010 | =O62 |
| 3 | 3 | 0011 | 0001X0011 | =B03 | 0010X0011 | =I18 | 0011X0011 | =N33 | 0100X0011 | =G48 | 0101X0011 | =O63 |
| 4 | 4 | 0100 | 0001X0100 | =B04 | 0010X0100 | =I19 | 0011X0100 | =N34 | 0100X0100 | =G49 | 0101X0100 | =O64 |
| 5 | 5 | 0101 | 0001X0101 | =B05 | 0010X0101 | =I20 | 0011X0101 | =N35 | 0100X0101 | =H50 | 0101X0101 | =O65 |
| 6 | 6 | 0110 | 0001X0110 | =B06 | 0010X0110 | =I21 | 0011X0110 | =N36 | 0100X0110 | =G51 | 0101X0110 | =O66 |
| 7 | 7 | 0111 | 0001X0111 | =B07 | 0010X0111 | =I22 | 0011X0111 | =N37 | 0100X0111 | =G52 | 0101X0111 | =O67 |
| 8 | 8 | 1000 | 0001X1000 | =B08 | 0010X1000 | =I23 | 0011X1000 | =N38 | 0100X1000 | =G53 | 0101X1000 | =O68 |
| 9 | 9 | 1001 | 0001X1001 | =B09 | 0010X1001 | =I24 | 0011X1001 | =N39 | 0100X1001 | =G54 | 0101X1001 | =O69 |
| 10 | A | 1010 | 0001X1010 | =B10 | 0010X1010 | =I25 | 0011X1010 | =N40 | 0100X1010 | =G55 | 0101X1010 | =O70 |
| 11 | B | 1011 | 0001X1011 | =B11 | 0010X1011 | =I26 | 0011X1011 | =N41 | 0100X1011 | =G56 | 0101X1011 | =O71 |
| 12 | C | 1100 | 0001X1100 | =B12 | 0010X1100 | =I27 | 0011X1100 | =N42 | 0100X1100 | =G57 | 0101X1100 | =O72 |
| 13 | D | 1101 | 0001X1101 | =B13 | 0010X1101 | =I28 | 0011X1101 | =N43 | 0100X1101 | =G58 | 0101X1101 | =O73 |
| 14 | E | 1110 | 0001X1110 | =B14 | 0010X1110 | =I29 | 0011X1110 | =N44 | 0100X1110 | =G59 | 0101X1110 | =O74 |
| 15 | F | 1111 | 0001X1111 | =B15 | 0010X1111 | =I30 | 0011X1111 | =N45 | 0100X1111 | =G60 | 0101X1111 | =O75 |

ENCODING SCHEME

Fig.3

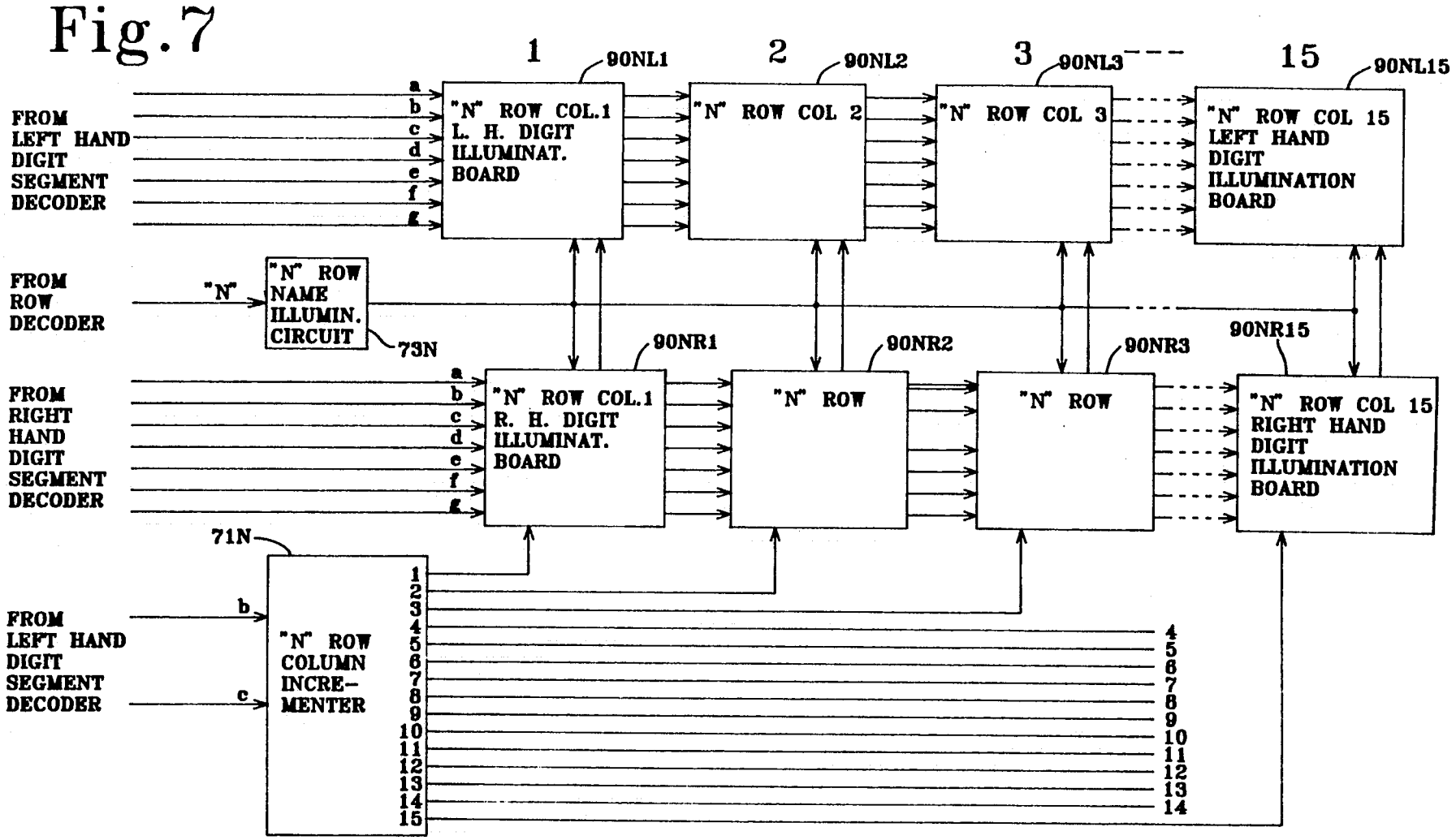
Fig. 7
FROM LEFT HAND DIGIT SEGMENT DECODER
FROM ROW DECODER
FROM RIGHT HAND DIGIT SEGMENT DECODER
FROM LEFT HAND DIGIT SEGMENT DECODER
"N" ROW NAME ILLUMIN. CIRCUIT
73N
"N"
"N" ROW COLUMN INCRE-MENTER
71N
"N" ROW COL.1 L. H. DIGIT ILLUMINAT. BOARD
90NL1
1
"N" ROW COL 2
90NL2
2
"N" ROW COL 3
90NL3
3
"N" ROW COL 15 LEFT HAND DIGIT ILLUMINATION BOARD
90NL15
15
"N" ROW COL.1 R. H. DIGIT ILLUMINAT. BOARD
90NR1
"N" ROW
90NR2
"N" ROW
90NR3
"N" ROW COL 15 RIGHT HAND DIGIT ILLUMINATION BOARD
90NR15

ELECTRONIC GAME DISPLAY DEVICE

DESCRIPTION

1. Technical Field

This invention relates to an electronic device for the display of numerical digits which are so arranged as to form letter-number coordinates as used in games such as Bingo, Keno, or the like, and more specifically concerns a system and devices for the encoding, transmitting, and displaying of not only such coordinate type data, but also data indicating the sequence in which each number was selected.

2. Background Art

Various devices have heretofore been used to track and display, often in row-column coordinate form, certain randomly selected digits, as used in games such as Bingo, Keno, or the like. Typically, in one exemplary embodiment, an operator makes a random selection of one ping-pong ball from among a number of similar balls, all of which have been labeled with one of the five letters "B", "I", "N", "G", or "O", and a number between one and seventy-five, for example. In some instances, there may be no display of the selected numbers. In others, signs, lights, and video devices have been utilized for this purpose. In these situations, the usual format has consisted of five letter rows matrixed with fifteen number columns. Of course, it will be realized that other formats are equally possible, such as six rows of ten numbers per row with a middle divider between the third and fourth rows, for example. Regardless of the display format employed, however, after a number has been selected the operator then announces such letter-number or row-column coordinate audibly, often over a public address system. Players subsequently use a marker to cover the grid location on a card which contains such announced coordinate location. This action continues until one or more players has covered all of the grid locations in a particular predesignated pattern, at which time that round of play is terminated, the winner is awarded a prize, and a new round is begun. In large halls with many players, the need arises for large and/or multiple displaying devices capable of continuously indicating each row-column or letter-number coordinate called and the sequence in which at least some of the numbers were called.

Prior art has included such devices as video cameras focussed on the last ball called and electronic memory storage for reconstruction of a set of digits in case of dispute or so-called "late" Bingo, but none of the previous methods has provided a truly automatic means of registering and indicating in a continuous fashion each selected coordinate pair simultaneously with the selection sequence. Cooper, et al, U.S. Pat. No. 4,218,063, teaches a masterboard with apertures and associated ball-actuated switches. However, PING-PONG balls, by their nature, lack the weight to satisfactorily actuate most mechanical switches; hence, the need for the device of the present invention which generates a signal when it detects the passage of a ball (or other opaque device) through beams of infra-red light.

Loyd Jr., et al, U.S. Pat. No. 4,332,389, teaches a last ball display but, in this device, the game must be stopped and the entire sequence of previously called numbers must be stepped through, digit by digit, in order to see more of a sequence than merely the last ball called. The device of the present invention provides a sequential display section as well as a coordinate display section.

Prior art also exists with regard to various methods of transmitting data from the game operator's console to a flashboard at one or more remote locations. However, these comprise mostly differences in electronic circuits and it has been obvious for years that many patentably different devices must, perforce, utilize the same electronic circuits in accomplishing different objectives. Thus, it will be seen that, although the individual electronic circuits of the present invention are not unique, the task accomplished by the sum of all its components is.

Accordingly, it is an object of the present invention to provide an improved electronic display system and device to aid in the playing of certain popular games, such as Bingo, Keno, or the like.

It is another object of the present invention to provide such an improved electronic display system and device which will not only display the selected coordinate numbers in their assigned rows in the sequence in which they were selected, but additionally provides a separate row which displays the numbers solely on the basis of the sequence in which they were selected.

It is a further object of the present invention to provide such a device which will simultaneously register and display the hereinbefore referred to coordinate and sequential numbers automatically and unequivocally with the deposit of the selected ball into a receptacle especially designed for this purpose built into a game operator's console.

It is another object of the present invention to provide such a system and device which will encode and transmit this coordinate and sequential data to one or more detached or remote receiving-displaying devices which may possibly be located at relatively great distances from the transmitting device.

It is yet another object of the present invention to provide such a receiving-displaying device which presents the desired coordinate and sequential data in such a way as to be easily seen by the viewer even though separated from the viewer by a considerable distance.

It is a still further object of the present invention to provide such a system and device which is able to simultaneously utilize multiple receiving-displaying devices which may be positioned at various remote locations.

BRIEF DESCRIPTION OF THE DRAWINGS

Other objects and advantages of the electronic game display device will become apparent upon reading the detailed description, together with the drawings described as follows.

FIG. 3 contains a coding and number equivalency chart to diagrammatically illustrate the encoding scheme utilized by such game displaying device.

FIG. 7 is a block diagram of the display section of such a game displaying device.

DISCLOSURE OF THE INVENTION

Figure 1:
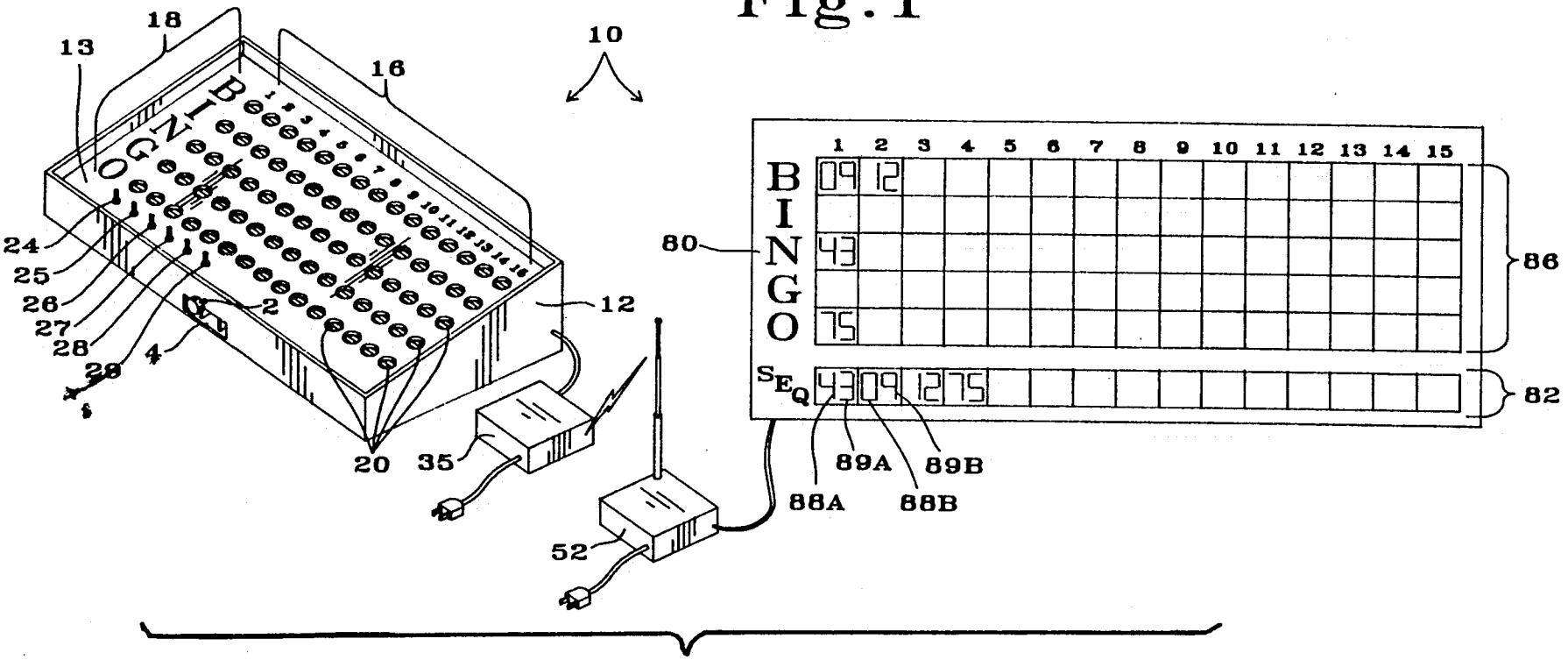
FIG. 1 depicts the major components of a game displaying system constructed in accordance with various features of the present invention illustrated generally at 10.
Figure 1A:
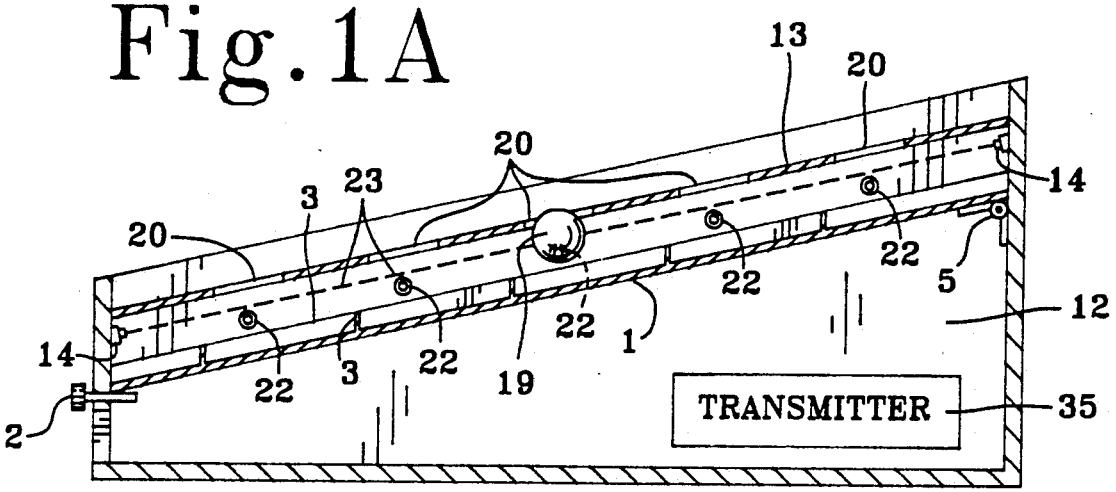
FIG. 1A is a sectional view of a console portion of the present invention, illustrating the row and column infra-red light beam planes and the ball holding deck.

An electronic alpha-numeric digit displaying device, together with a control unit and electronic circuitry appropriate to the encoding, sending, receiving, decoding, and displaying of data as used in various games, such as Bingo, Keno, or the like. This system is particularly designed to automate and display, in an unequivocal format, the pertinent information of certain popular games and will be described first in terms of its components and next in connection with its operation.

In a preferred embodiment, the control portion of a device constructed in accordance with various features of the present invention is comprised of a console of four walls with a top and bottom which cooperatively enclose a volume. The dimensions of such peripheral components are not critical and can be altered within a range of sizes. In a preferred embodiment, the console is sized so as to sit on a desk, or a table, or the like.

The top of the console is a smooth, flat surface of wood, plastic, metal, or such like material, and is inclined upwardly away from the position at which an operator would sit. This top surface plate is perforated by seventy-five holes, each hole being of the appropriate size to receivably allow the passage of an object such as a PING-PONG ball. These perforations are equidistantly spaced from each other, and arranged in five rows of fifteen columns per row. The rows are labeled along the left-hand side "B", "I", "N", "G", and "O", from top to bottom. The columns are labeled from "1" to "15" inclusive, left to right at the tops of the columns. This top plate can further contain vertical dividing slats of plastic or such like material, arranged in a grid pattern, enclosing each one of the holes within a square enclosure formed by the vertical dividing slats. These vertical dividing slats assist the operator in getting the ball into the correct hole. Also mounted onto the inclined top plate are various electronic control switches. To provide access to the interior of the console, the top plate is hingedly attached to one of the vertical wall portions of the console box, preferably the tallest one, which is distal from the operator's position proximate the shortest wall. The top plate rests on supports attached to the other three walls approximately one and a half inches below the top edges.

Located within the volume enclosed by the console are various electronic components and wiring, comprising the ball detection and encoding/transmitting circuitry. Below the level of the lower infra-red light beam is a ball retention deck with partitions dividing the surface area into cubical compartments. The partitions are mounted to the interior walls of the console. When balls are dropped into their respective holes, they drop into one of these compartments where they are held until the game is over. At that time, the operator can pull a release lever to release the balls for reuse.

The ball detection means is comprised of a series of infra-red light emitter-receiver sets, one set aligned with each one of the five rows of holes in the top plate, and one set aligned with each one of the fifteen columns of holes in the top plate, a total of twenty such emitter-receiver sets. When a PING-PONG ball (or any opaque object) passes through one of the holes in the top plate, it will interrupt two beams of light between emitter-receiver sets; one between the emitter and receiver of a set aligned with the row in which the hole is located, and one beam of a set aligned with the column in which the hole is located. In this manner, each hole location is identified by a unique, row-column address.

These interruptions in the light beams are detected, translated into trains of pulses, and transmitted by the electronic circuitry of the transmitter located in the interior of the console to a receiver at the remote displaying device.

These pulses are received by the receiver preferably located in the display board. Here, the pulses are decoded into drive signals to illuminate the appropriate light bulbs of the display board.

The display board portion of the present invention comprises a preferably rectangular housing means constructed of some strong, rigid material, having a back cover and a front cover, which cooperatively enclose a volume. The front cover of this housing is comprised of a specially marked face plate hingedly attached thereto.

This face plate is made opaque except for fourteen slot-shaped transparent areas set in blocks of fifteen columns and six rows, two groups of seven transparent slots to each block. Each group of seven transparent slots is arranged in the familiar configuration used by digital displays comprised of Light Emitting Diodes or Liquid Crystal Displays. Instead of an LED, however, a light bulb, incandescent or fluorescent, for instance, is mounted behind each slot. When the light bulbs proximate the appropriate segment areas are energized, a two-digit number can be displayed.

Located within the housing and behind the face plate is an arrangement of substantially cubical compartments, each of which contains an electronic component board, with light bulb and socket configurations attached thereto. Within each of these compartments, which may also be called cells, a light-tight enclosure is provided around each particular light bulb and its associated transparent slot. When an electronic signal has been received, decoded, and sent to the appropriate cell component board and a group of bulbs is energized, the light from the bulbs is visible through the transparent portions of that area of the face plate, revealing the seven-segment characters thus outlined by such transparent portions.

The desired letter-number characters are arranged in a pattern corresponding to the labeling on the PING-PONG balls as has been previously described. In the exemplary preferred embodiment, the top five rows are labeled, from top to bottom, "B, I, N, G, O." Each row will contain fifteen two-digit numbers, appearing in the sequence in which they are called. The "B" row will contain the numerals 01 to 15: the "I" row will contain the numerals 16 to 30; "N", 31 to 45, "G" is for 46 to 60: and "O", 61 to 75. A sixth row, also comprised of two seven segment digits in each of fifteen positions, will allow the first fifteen numbers called to be displayed in the sequence in which they were called, concurrently with that number's occurrence in the row-column display. In another embodiment, the sequential display row can consist of the continuous display of the last fifteen numbers selected, instead of the first. It will be seen that fifteen is an arbitrary number and the actual number used can be either greater or smaller.

In a preferred embodiment, the display board is portable and capable of being suspended or self-supporting. Wheels and/or legs, suspension lugs, or other devices can be attached thereto. If carrier-current transmission is utilized, all signal and power input requirements are satisfied when the power cord is pluggably connected to a standard 115 VAC receptacle which is powered by the same power line transformer as the transmitter. However, it will be noted that other embodiments could include, for instance, the use of coaxial cable or any of various types of wireless transmission schemes for data signal input.

In use, the game operator would deposit randomly selected PING-PONG balls into the appropriately numbered receptacle in the console portion of the present invention. The ball thus deposited would, in passing into the volume enclosed by the console walls, momentarily interrupt two infra-red light beams, causing the generation of an electronic signal uniquely identifying the receptacle into which the ball was placed. This signal would be encoded and transmitted to a receiving-displaying device where it would be decoded and converted into illuminated light bulbs which would display the number on an appropriate letter row simultaneously with a sequential row for reading by the players of the game. Other appendant functions of the game can be incorporated by attaching other switches and controls.

It will be immediately obvious to those skilled in the art that alternate embodiments of the present invention are possible. For instance, one such alternate embodiment could include the marking of the PING-PONG balls with special ink and/or character designs suitable for reading with a Magnetic Ink Character Reader or an Optical Character Reader or such-like device. Data generated by such a device, however, would still need to be routed to the electronic circuitry for encryption and transmission in a manner similar to that which will be described in more detail in subsequent portions of this application.

BEST MODE FOR CARRYING OUT THE INVENTION

An electronic game-displaying system and devices constructed in accordance with various features of the present invention are illustrated generally at 10 in FIG. 1 of the drawings.

In a preferred embodiment, a console 12 is provided which can be similar to a speaker's podium in appearance and/or construction. The upper surface 13 of console 12, inclined upwardly away from the operator, is perforated by a plurality of holes 20. The holes 20 are arranged in an exemplary embodiment in five rows 18, labeled "B," "I," "N," "G," and "O," of fifteen columns 16, numbered from "1" to "15." Thus, each hole 20 is uniquely identified by a letter-number coordinate pair, as "B 12", for instance.

A plurality of infra-red light emitter-receiver sets 14 is mounted on the interior walls of the console 12. In a preferred embodiment, there are 20 sets 14, one set 14 mounted in line with each one of the fifteen columns 16 of holes 20, and one set 14 mounted in line with each one of the five rows 18 of holes 20. Thus, each hole 20 is bisected in the Cartesian coordinate "X" plane by the light beam 22 of a row IR set 14, and bisected in the "Y" plane by the light beam 23 of a column IR set 14. All of the IR sets 14 are mounted so that their beams are in two separate horizontal planes, with the plane of the beams 23 of the columns 16 being vertically separated from the plane of the beams 22 corresponding to the rows 18. Thus, any opaque object 19 dropped into one of the holes 20 interrupts two infra-red light beams 22, 23, one for a row 18, and one for a column 16, sending an appropriate identification signal to the electronic circuitry in transmitter 35.

An interior ball retention deck 1 is attached to an interior wall of console 12 by a hinge 5 and held in playing position by release lever 2. A grid of horizontal and vertical partitions 3 is attached to the interior walls of console 12 and held suspended flush against the upper surface of ball holding deck 1. When a ball 19 is dropped, it is held by partitions 3 and deck 1 in its position until the game is finished. At that time, the operator can pull release lever 2, allowing the end of deck 1 proximate lever 2 to drop and release balls 19 through exit 4.

Figure 4:
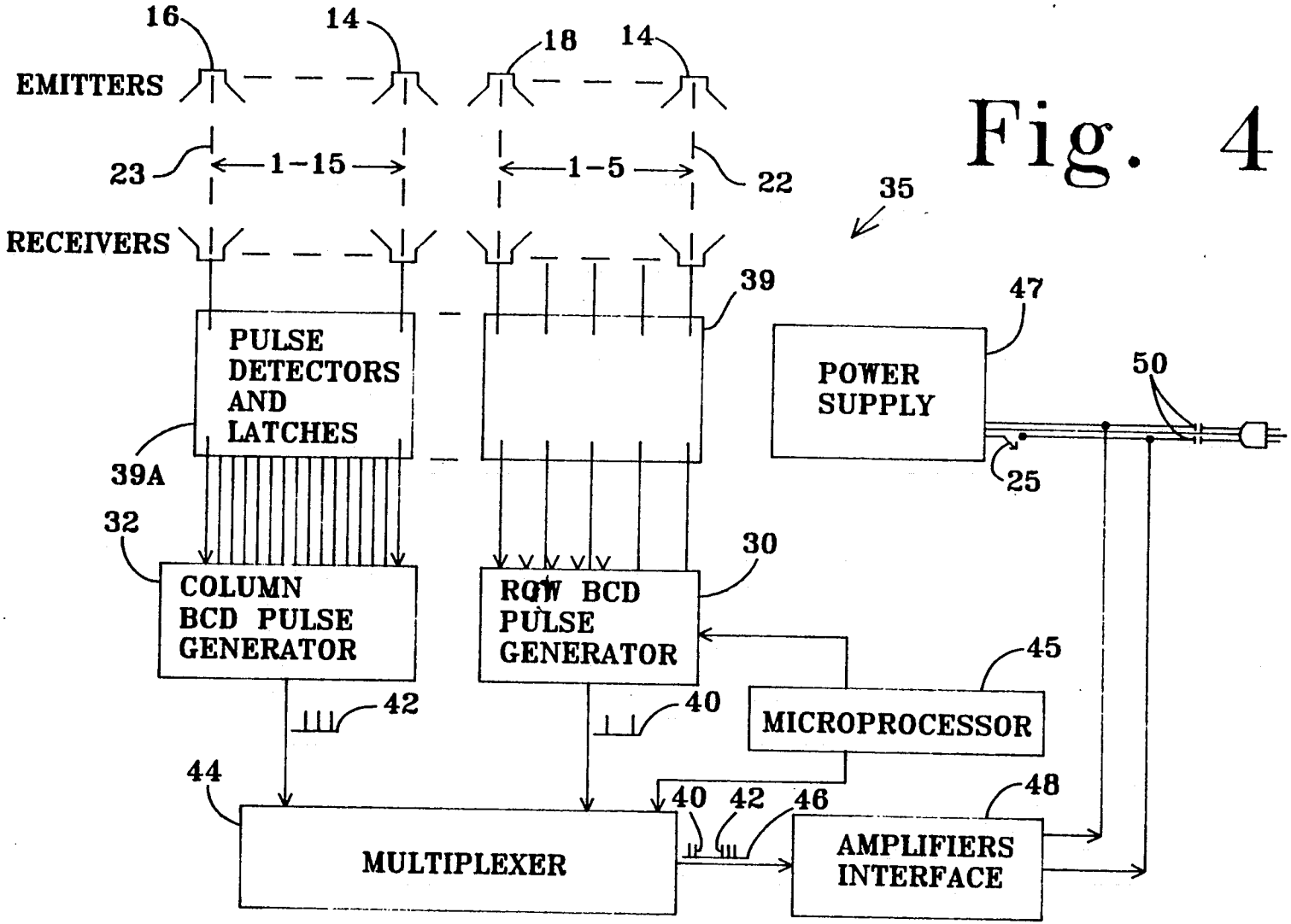
FIG. 4 is an illustration of a transmitting circuit block diagram which can be used as part of such a game displaying device.

As can be seen in FIG. 4, each IR light pair (set) 14 of a row 18 is wired to a specific input terminal of row BCD pulse generator 30 through detector/latches 39. In like manner, each IR light set 14 of a column 16 is wired to a specific input terminal of column BCD pulse generator 32 through pulse detector/latches 39A. In a preferred embodiment, pulse generators 30, 32, and latches 39, 39A, are integral parts of transmitter 35, inside console 12.

Pulse generators 30 and 32 generate sequences of pulses which are unique for each input terminal. Thus, any interruption of the IR light beam 22 of an IR set 14 of any row 18 will cause the generation of a pulse train 40 that is uniquely encoded to that particular row 18. Likewise, any interruption of the IR light beam 23 of an IR set 14 of any column 16 will cause a pulse train 42 uniquely coded to that particular column 16 to be generated by the column BCD pulse generator 32. The pulse trains 40, 42 so generated are routed to a multiplexer 44 for combining and sequencing into a serial format pulse train 46. Microprocessor 45 times and coordinates the operation of the encoding and transmitting section, and power supply 47 is a standard state of the art five volt Vcc supply.

After multiplexing at 44, the pulse train 46 is amplified by a conventional power amplifier 48 and capacitively coupled 50 into the building's AC supply voltage line in one embodiment. However, it will be seen by those with expertise in the field that any transmission means could be utilized, including but not limited to, coaxial cable, fiber-optic cable, laser light, infra-red light, and/or wireless radio, via any type of modulation desired.

Regardless of the transmission method utilized, the row-column information corresponding to the interruptions of specific light beams 22, 23, is encoded in the pulse train 46 in accordance with the chart of FIG. 3. Referring to FIG. 3, the encoding method used in one embodiment of the present invention is of the type known as Binary Coded Decimal (BCD) which uses four positions of Base 2 values to represent sixteen different four digit numbers, including 0000. A one (represented by a pulse) in the left-most of the four positions is an indicator of the presence of the value 2 raised to the third power (or 2 cubed), which is the value 8 in the standard decimal (base 10) system. A one in the next place from the left would indicate the value of 2 squared (2 to the second power, which is 4); the next position is for 2 to the first power (2), and, finally, a one in the right hand-most place represents a 2 to the zero power, which is the value 1 in both systems. Therefore, the decimal value one is represented in BCD as 0001, two is 0010, three is 0011, eight is 1000, etc., as illustrated in the chart of FIG. 3. The absence of a pulse is a zero. The presence of a pulse is referred to as a "one" or, in this case, the presence of the value of that position. Just as, in the Base 10, a one in the right hand-most place equals the presence of the value of 1 (10 to the zero power), a one in the second place from the right equals 10 (10 to the first power), in the third place 100 (10 squared), or in the fourth place from the right, 1000 (10 cubed), etc., so also does a one signal the presence of an 8, a 4, a 2, or a 1 in Base 2, (or Binary). Thus, 1011, in Base 2, equals an 8 plus a zero plus a 2 plus a 1, which equals 11 in Base 10. However, to translate each of the digital values between zero and fifteen as single digits requires the use of another coding method in conjunction with BCD coding. Hexadecimal coding is a scheme for allowing the representing of up to 16 single digit numerals in a single column instead of being limited to 10 per column as in the decimal system. In the hexadecimal system, the numerals above 9, which are normally two digits, are represented by the first six letters of the alphabet. Therefore, 10=A, 11=B, etc. Conventionally, hexadecimally coded numbers are prefixed by the dollar sign, $, in notation. Thus, as utilized by the present invention, the digits 1 through 9 in the decimal system are the same as $1 ("hex one") through $9 ("hex nine") in the hexadecimal system, and equal 0001 through 1001 in BCD. However, the difference between the two systems begins at 10 decimal which equals $A ("hex A") in hexadecimal, and 1010 in BCD, as illustrated in FIG. 3.

In the present invention, rows are represented by a left-most series of four BCD places, and columns are represented by a right-most series. Because there are only five rows to be encoded, these five addresses can be represented by 0001 through 0101 Base 2, leaving the values 8 through 12 (base 10) (1000 through 1100 Base 2) free to be used to encode other things, such as signals from control switches on the console, for instance. Therefore, this has been done for five switches in the present invention as follows:

1000×0000=Cancel Last Entry Switch 26
1001×0000=Reset/Clear Board Switch 28
1010×0000=Replay Sequence/Check Switch 27
1011×0000="Next" Switch 29
1100×0000=Cancel Replay/Restore Board Switch 24

The second half 42 of the serial pulse train 46, separated from the first half 40 by a blank position one pulse width wide (indicated by x), is used to indicate the number (column) address. These four positions are created in the same manner as the first four, except that the pulses filling these positions are generated by the column generator 32 instead of the row generator 30. These four pulse positions are used to represent 75 numbers by using each group of fifteen codes with a different row code. Each combination, therefore, is made to represent one of five different values, depending on which row code train is used with it. In this manner, the same fifteen codes which would equal 01 to 15 when used with a B row code, would equal 61 to 75 when used with an O row code. Thus, 0001×1111 would equal B 15, and 0101×1111 would equal O 75.

Figure 5:
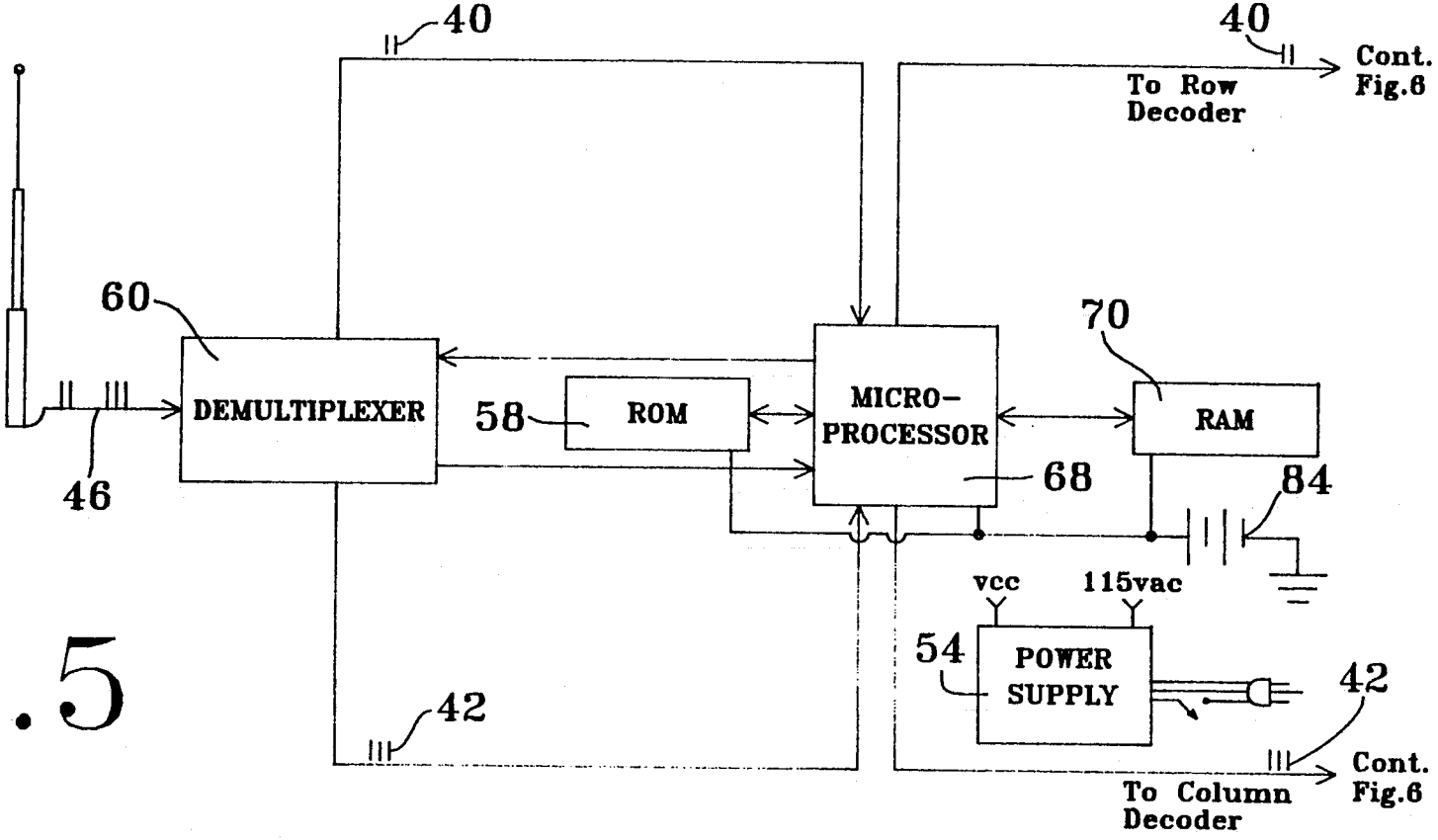
FIG. 5 is a block diagram of a receiver section which can be used as part of such a game displaying device.

In FIG. 5, the combined serial pulse train 46 is shown being received by receiver 52. After this pulse train has been demultiplexed at 60, row pulse train 40 and column pulse train 42 are fed to the microprocessor 68 for processing, storage in Random Access Memory (RAM) 70, and then on to the decoding section in FIG. 6. The pulse train data entered into microprocessor 68 is sent to RAM 70 and stored so that if a power failure should occur, microprocessor 68 and the "keep-alive" battery 84 will ensure that the data in RAM 70 is saved. After power has been restored, "Cancel Replay/Restore Board" switch 24 on the console 12 can be activated to send the "restore" pulse train signal to the microprocessor 68 so it will return the display board 80 to the status prevailing at the time of the power outage. Read Only Memory (ROM) 58 contains the previously stored program of commands which controls the actions of microprocessor 68. Power supply 54 supplies the five Volts DC for the entire display board 80, and also all the 115 Volts AC, which is switched by an internal relay, not shown. Power for display board 80 is supplied through switch 49.

Figure 6:
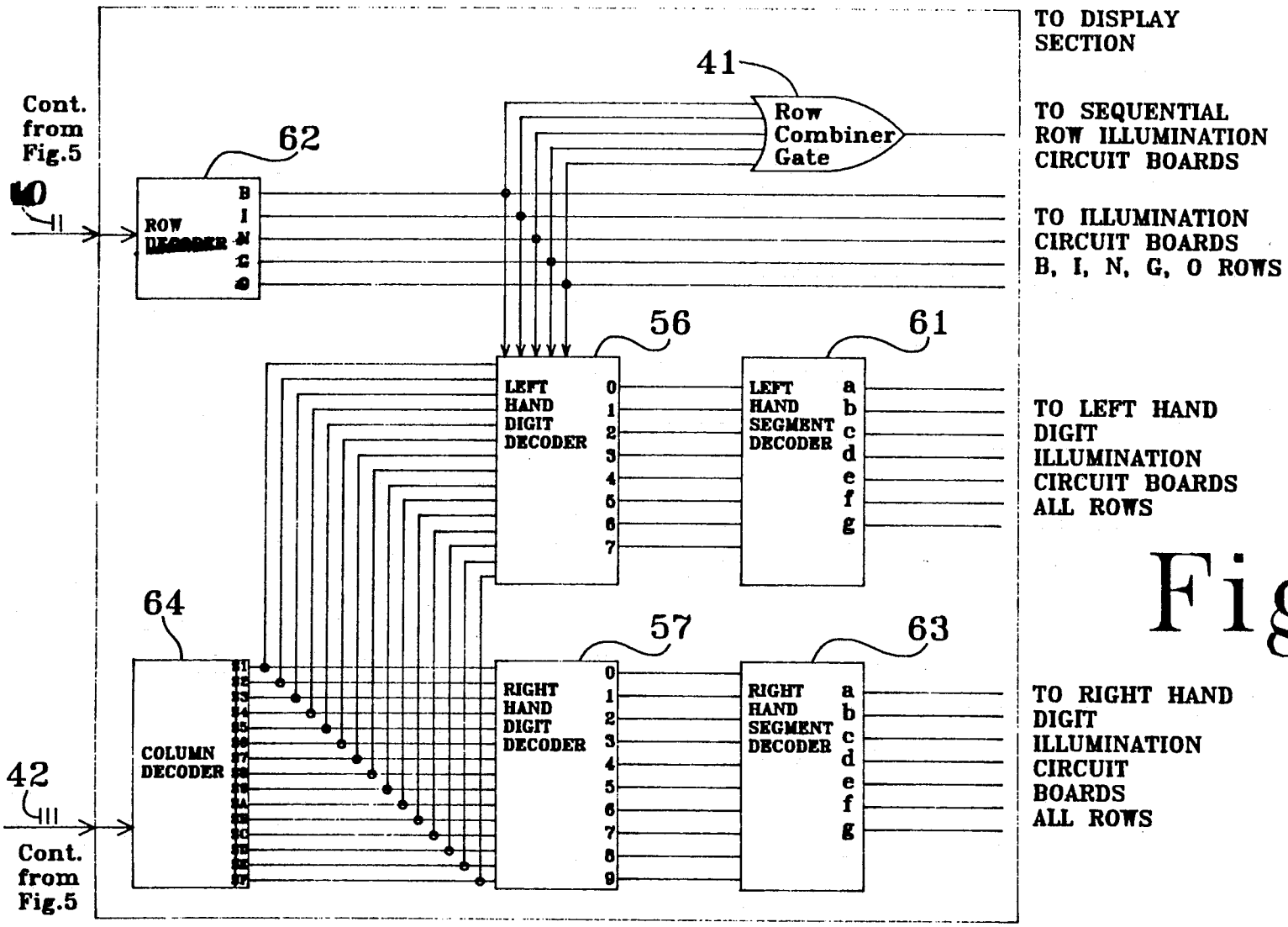
FIG. 6 is a block diagram of the decoding circuit of such a game displaying device.
Figure 9:
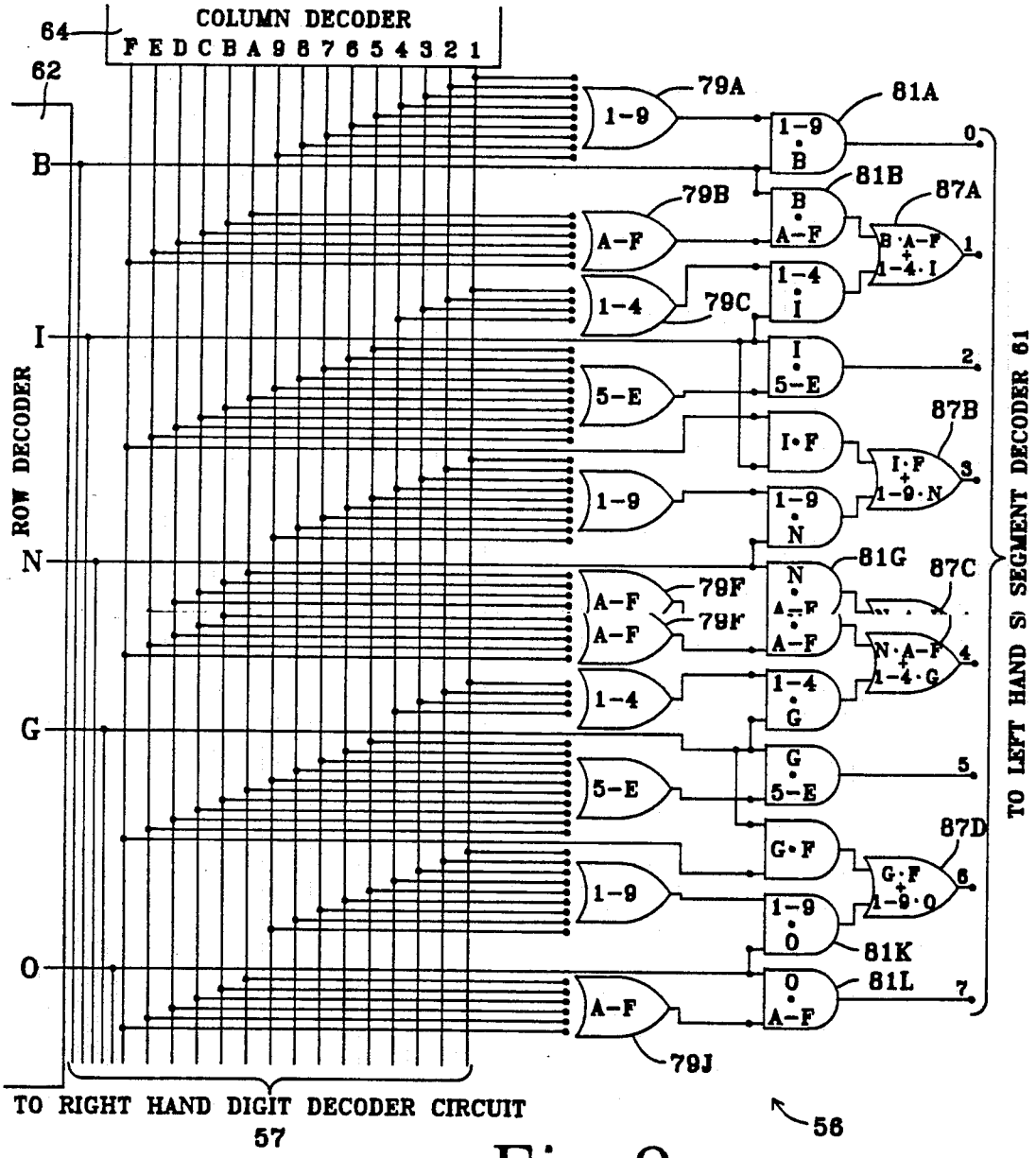
FIG. 9 is a block diagram of the left hand digit decoder circuit.
Figure 10:
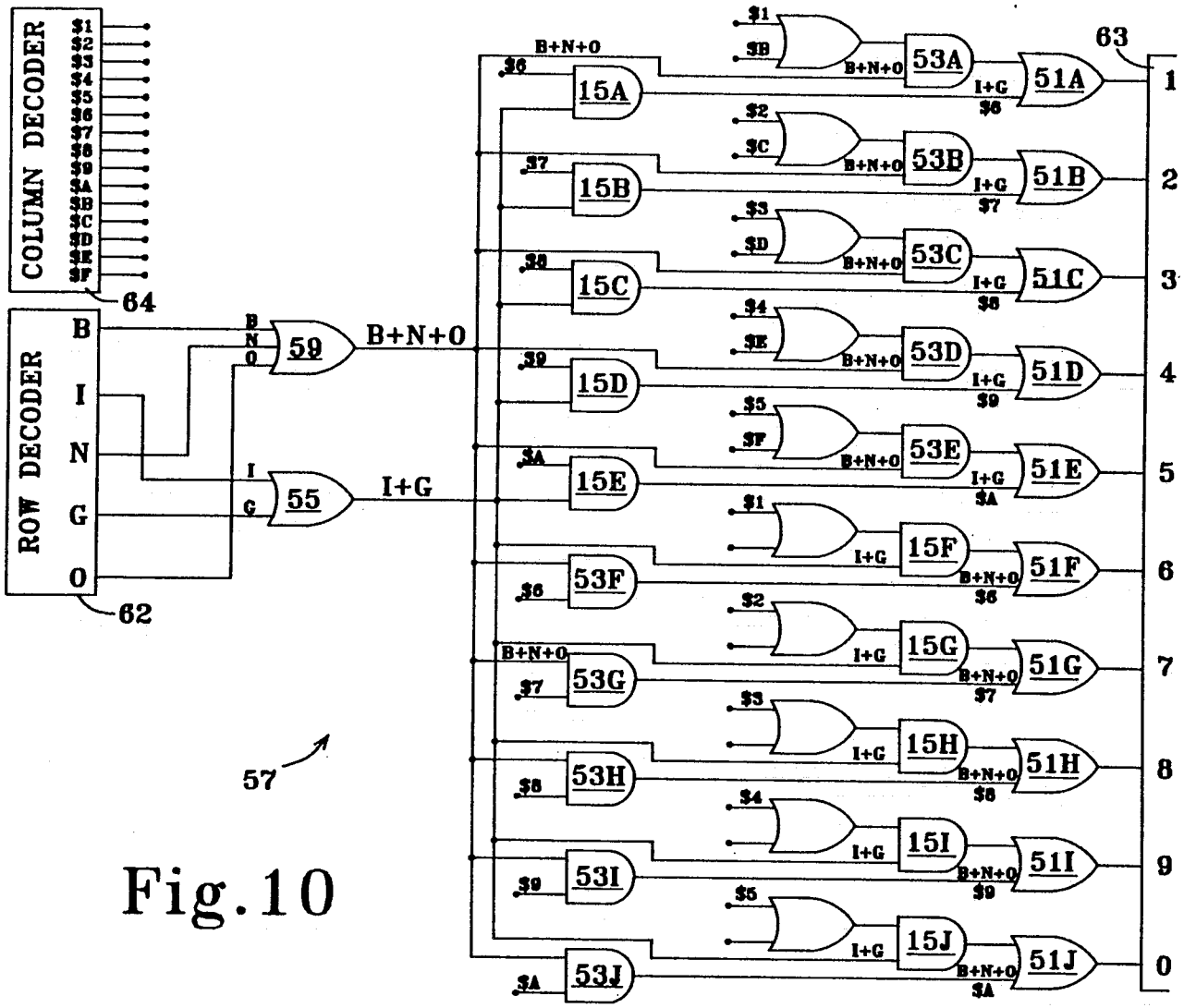
FIG. 10 is a block diagram of the right hand digit decoder circuit.

In FIG. 6, row pulse train 40 and column pulse train 42, after having passed through the microprocessor 68, are routed to row decoder 62 and column decoder 64, respectively. Block diagrams of these circuits are shown in FIGS. 9 and 10, and a more detailed explanation of their operation follows later.

In the decoding section shown in FIG. 6, the pulse trains are translated in row decoder 62 and column decoder 64 into single pulses on the output lines appropriate to the input signal. For instance, "N 43" would become a pulse on the "N" output line of the row decoder 62 and a pulse on the "$D" output line of column decoder 64. The outputs of both of these decoders go to the left-hand and right-hand digit decoders, 56 and 57, respectively. In addition, parallel outputs from row decoder 62 are routed to the appropriate digit illumination boards 90x as row selector signals. Row combiner gate 41 is an OR gate which provides a row select signal to the sequential display "S" row digit illumination boards 90S no matter which of the other rows is selected.

Figure 2:
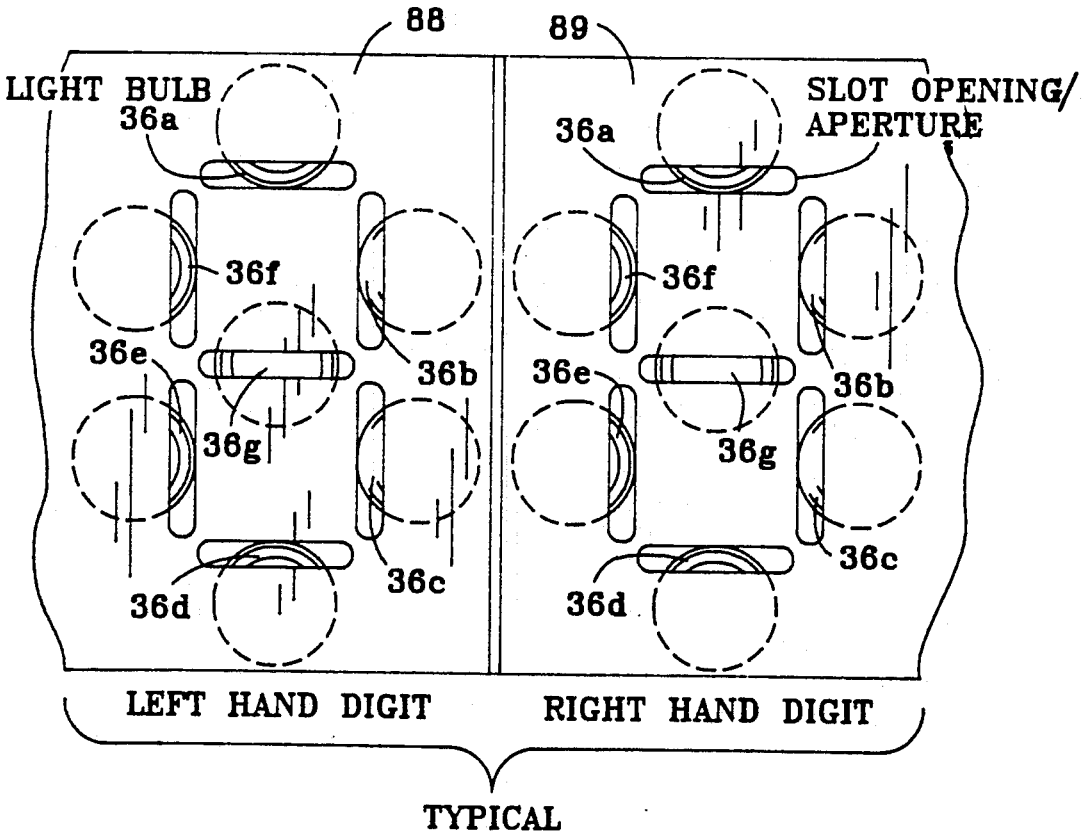
FIG. 2 is a drawing of the method of creating the seven segment display digits by the use of light bulbs and oblong shaped transparent areas of the display face plate.

The eight output lines corresponding to the numerals 0 through 7 from left-hand digit decoder 56 carry signals to left-hand segment decoder 61. Similarly, the ten output lines corresponding to the numerals 0 through 9 from right-hand decoder 57 carry signals to right-hand segment decoder 63. For the continued use of the analogy "N 43," a pulse would be present on the "4" line of left-hand digit decoder 56, and the "3" line of right-hand digit decoder 57, as well as on the "N" line of row decoder 62. The segment decoders, 61, 63, convert input pulses into pulses on their output lines to cause the illumination of the correct segments of a standard seven segment display, as illustrated in FIG. 2. The output of the left-hand segment decoder 61 would be a pulse on each of the "b", "c", "f", and "g" segment lines for a "4," and a pulse on each of the "a," "b," "c," "d," and "g" lines of right-hand segment decoder 63 for a "3."

The row signal from row decoder 62, the signal from row combiner gate 41 to the "S" row, the pulses on the appropriate output lines of segment decoders 61 and 63, are all routed to the digit illumination boards 90*x*, in the display section, illustrated in FIG. 7.

Figure 11:
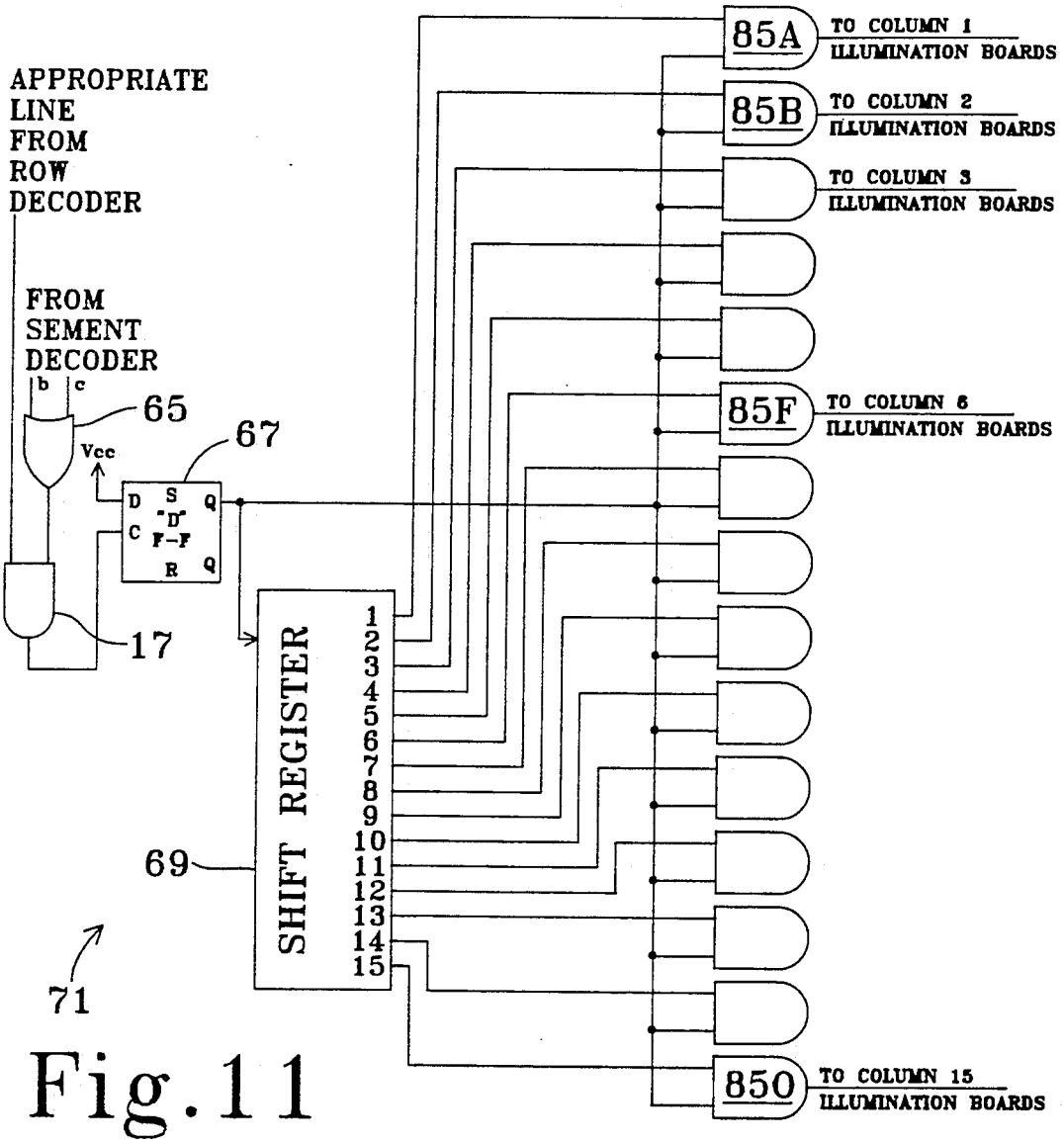
FIG. 11 is a block diagram of a column incrementer circuit.
Figure 12:
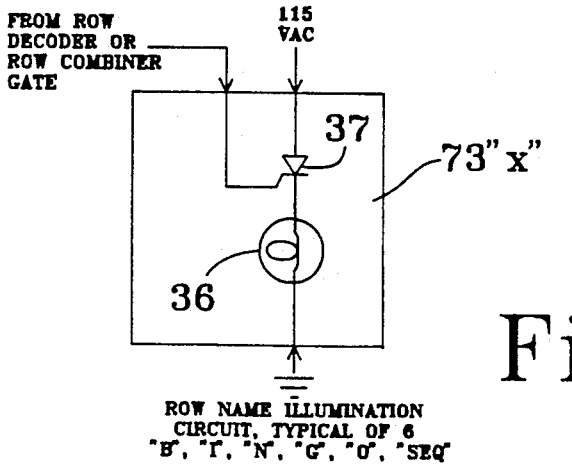
FIG. 12 is a block diagram of a row name illumination circuit.

Referring to FIG. 7, the row select signal for the "N" row is shown being applied to the row name illumination circuit 73N. This lights the bulb behind the letter "N" of that row on display board 80. A detailed view of the row name illumination circuit is shown in FIG. 12 and a more detailed explanation of that circuit's operation follows later. The row select signal is also conducted to each of the 30 digit illumination boards 90*x* on each row. In FIG. 7, only eight representative boards of one row are shown for reasons of space. Because every seven segment digit used requires either the segment "b" or the segment "c" in its structure, the "b" and "c" segment decoder output lines are also wired to the column incrementer 71*x* on each row. Thus, after a number has been entered in a particular colum of a particular row, each new number to be displayed on that row is moved to the next column to the right through the use of the "b" or "c" segment pulse as an indication of the presence of a new digit. A block diagram of the column incrementer 71 is shown in FIG. 11 and a more detailed explanation of this circuit follows later.

Figure 8:
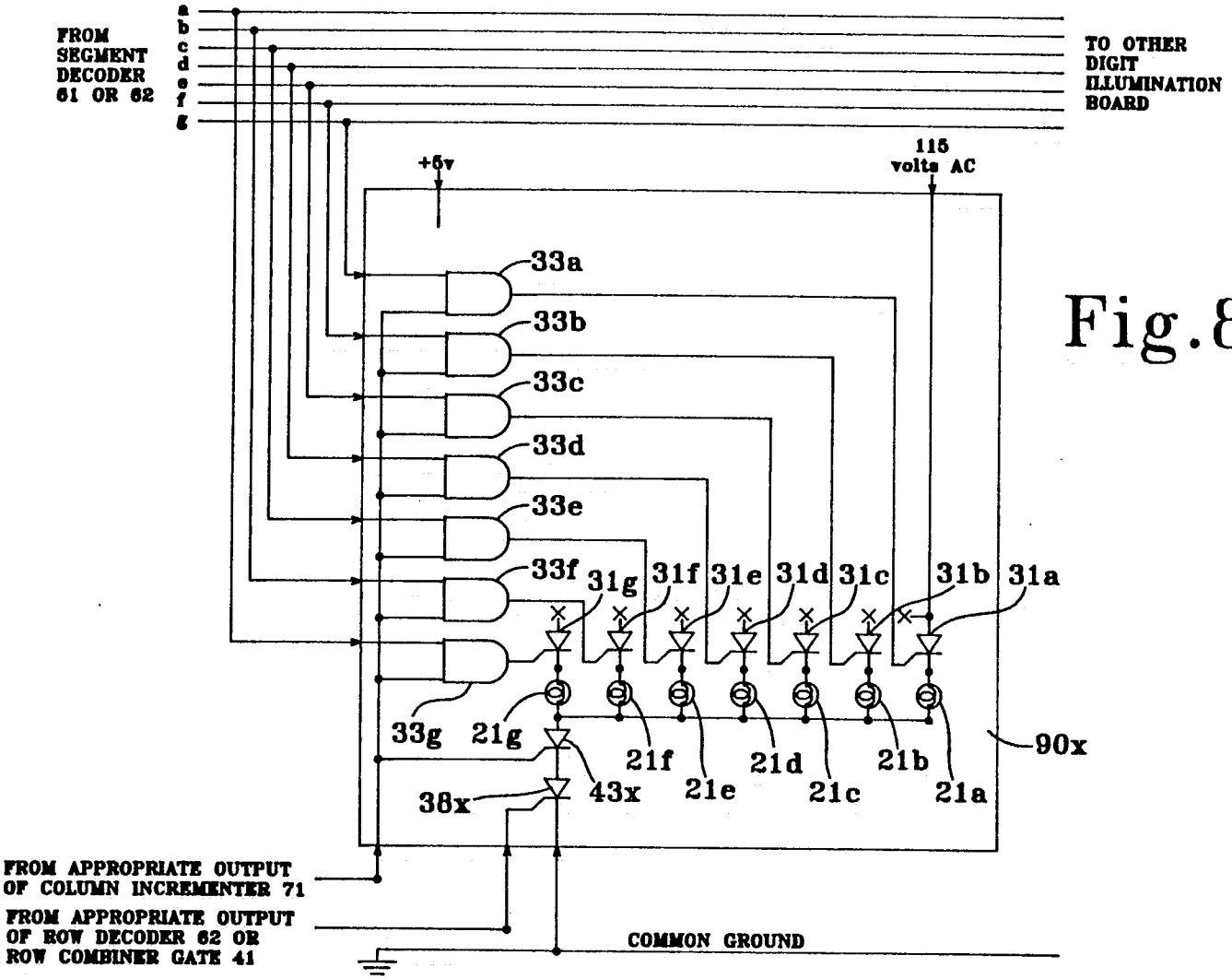
FIG. 8 is a block diagram of a digit illumination circuit.

A block diagram of the digit illumination circuit board 90*x* is shown in FIG. 8. The 115 Volts AC potential is wired to each of the Silicon Controlled Rectifiers (SCR) 31 which are essentially open circuits until biased into conduction by pulses on their gate electrodes. Pulses on the segment decoders 61, 63 are applied to one input leg of AND gates 33*x*. The other input leg of each gate 33*x* is tied in common to the output of column incrementer 71*x* for that row. Thus, each gate 33*x* with a pulse on both a segment input leg and the column incrementer input leg will be enabled, passing a pulse to the gate electrode of matching SCR 31*x*. For the digit "4", gates 33*b*, 33*c*, 33*f*, and 33*g* are enabled, as are SCRs 31*b*, 31*c*, 31*f*, and 31*g*. This action allows the AC voltage to be applied to bulbs 21*b*, 21*c*, 21*f*, and 21*g*. The pulse on the column incrementer input line also energizes column select SCR 43*x*, closing one more link in the circuit. The row select signal pulse will energize the row select SCR 38*x* of all the digit illumination boards 90*x* of the selected row only, finally completing the circuit from common ground return to the AC voltage through the selected light bulbs, causing them to be illuminated. Once an SCR has been energized, it will remain so until the AC voltage is removed, thus holding all previously illuminated numeral segments in the On position. The AC voltage is normally not removed until the display board 80 is completely Reset by the operator. The AND gates 33*x* on the segment input lines are to prevent the most recent segment signals present on the lines from changing the configuration of a preceding digit.

Simultaneously with the illuminating of the light bulbs on a coordinate position row, the same row select signal is fed from row combiner gate 41 to the SCR 38S on each of the digit illumination boards 90S of the "S" row, the sequential row. In this manner, any selected number is displayed in both its coordinate (86) and its sequential (82) positions, simultaneously. Thus, one look at the display board 80 tells the viewer which row-number pairs (section 86) have been called out by the operator, and the sequence (section 82) in which they were called. Of course, the selection sequence within each row is obviously left to right.

Referring to FIG. 9 for a more detailed explanation of the operation of left-hand digit decoder 56, it can be seen that the presence of a pulse on any one of the 15 output lines from the column decoder 64 is passed through the particular OR gate 79*x* to which that line is connected. For instance, a pulse on any of the lines $A through $F would pass through OR gate 79F to one input leg of AND gate 81G. The other required input to AND gate 81G is from the "N" output line of the Row Decoder 62. Thus, an "N" pulse and a $D would result in an output pulse from AND gate 81G which would go through OR gate 87C to the left-hand segment decoder 61 to generate the digit "4" for display as the left hand digit 88 for numbers in the forties. The "N" signal is also used in AND gate 81F to create a "3" digit for numbers in the thirties.

The generation of the remaining digits used in the left hand digit location 88 is accomplished in a similar manner. In the embodiment described and illustrated, only the digits 0 through 7 are utilized in the left digit 88 because the game being described only uses the numbers one through seventy-five. Obviously, other formats and embodiments can be utilized within the concept and scope of the present invention.

The operation of the right-hand digit decoder circuit is best explained with reference to FIG. 10. The right hand digit 89 uses all ten of the conventional numerals zero through nine. FIG. 10 is a block diagram of the circuit in which signals from the row and column decoders are transformed into the right-hand digit 89 of the two-digit display. A "B" or an "N" or an "O" signal from Row Decoder 62 is sent through OR gate 59 to one of the input pins on each of ten AND gates 53A–J, as identified by the notation B+N+O, which is read "B or N or O." Boolean algebra notation utilizes the mathematical symbols for addition to represent a logic OR function and the symbols for multiplication to represent a logic AND. A signal on either the "I" or the "G" line goes from OR gate 55 to the remaining ten AND gates 15A–J.

The process of deriving the digit "3" of "N 43" for display in the right side half 89 of the two-digit display in any of the fifteen columns is typical of the manner in which the other nine right-hand digits is derived. At AND gate 53C, the signal B+N+O and $D, from the S3+SD OR gate, together create an output signal pulse which passes through OR gate 51C to cause segment decoder 63 to activate the segment lines appropriate for the digit "3". For a row signal of "B", or "N", or "O", the output digit would be the 3 of 03, 13, 33, 43, 63, or 73. For a row signal of "I" or "G", the output digit would be the 3 of 23 or 53. Similarly, the signals $7 and I or G produce the 2 for 22 or 52, while either $2 or $C and a B or N or O generates the 2 for 02, 12, 32, 42, 62, or 72.

The column incrementer circuit can best be explained with reference to the block diagram of FIG. 11, wherein it will be seen that the "b" and "c" segment signals are applied to the digit detector OR gate 65. Because no seven segment digit can be created without using either a "b" or a "c" segment, along with others, the presence of one of these pulses indicates the presence of a digit to be displayed. When a pulse is present on one of the input legs of OR gate 65 for a particular row, then, an output pulse is generated, which is applied to an input of AND gate 17. When a row select pulse from row decoder 62 is present on the other input leg of AND gate 17, that device generates an output pulse, likewise. Thus, it can be seen that both a row select signal and a digit present signal are required to generate an output pulse from AND gate 17. When both of these signals are input to AND gate 17, that gate will send an output pulse to the CLOCK input of "D" type flip-flop 67. Because Vcc is wired to the D input of flip-flop 67, every output pulse of gate 17 will "clock" this "high" logic level to the Q output. The Q output signal goes to one input of all the AND gates 85*x* and to shift register 69. Thus, the first Q output pulse enables the AND gates and generates an output on the "1" line of the shift register which goes to the other input of AND gate 85A. With a signal on both inputs, this gate is enabled and passes a pulse out to the column select SCR of the digit illumination board 90*x*. The next segment pulse arriving at the column incrementer board would enable the "2" line, along with gate 85B. Thus, each column board is turned On with a particular configuration and left, with the output selector incrementing to the next position. The circuit can be set so that, after the fifteenth column has been activated, changes to the display can be made to cease until the board is reset, or to start over again at the first column with the sixteenth number.

If the latter method is preferred, the last fifteen numbers called by the game operator will be displayed in a continuously updated fashion at all times, the latest one called replacing the number previously displayed in that particular column.

The block diagram for row name light illumination circuit 73*x* is shown in FIG. 12. The 115 Volts AC potential is present at the point indicated when power switch 49 is turned On. SCR 37*x* is fired by the presence on its gate electrode of the appropriate row select pulse from row decoder 62 or row combiner gate 41. When SCR 37*x* is fired once, bulb 36*x*, behind the transparent outline section of the face plate, will illuminate and remain so until the circuit is reset.

In order to successfully operate the game displaying device, several manually operated switches have been provided. In a preferred embodiment, six switches are installed on the console 12 and one on the receiver 52. Switch 25 on the console 12 and switch 49 on the receiver 52 are Power On/Off switches for their respective locations.

Switch 26 on the console 12 is the Cancel Last Entry switch, by means of which an inadvertent entry, such as a ball dropped in the wrong hole, for instance, can be erased. Switch 27 is the Replay Sequence/Check switch by means of which all claims or misunderstandings can be settled. Turning this switch to the On position suspends regular play by switching the microprocessor into a reverse, one-step-at-a-time mode. While in this mode, each number previously entered will be displayed in reverse sequence by operating the Next switch 29 to step from one number to the next. At the conclusion of this check, or following any power outage, the Cancel Replay/Restore Board switch 24 is used to restore the display board 80 to the state it was in at the time of the interruption and reinitiate play. The Reset/Clear Board switch 28 is used to restore all circuits to zero and begin a new round of play.

While a preferred embodiment of an electronic game displaying system and devices have been shown and described, it will be understood that there is no intent to limit the invention to such a disclosure but, rather, it is intended that the disclosure cover all modifications and alternate constructions falling within the spirit and scope of the invention as defined in the appended claims.

I claim:

1. A device for displaying numerical digits in both a coordinate location area, and in a sequence of selection order area, together with a control unit and electronic circuitry appropriate to the encoding, sending, receiving, and decoding of data representative of said digits, comprising:

an operator's console fitted with a plurality of receptacles uniquely identified by row-column coordinates for receiving balls with encoded identification markings imprinted thereon, said markings corresponding to said uniquely identified receptacles;

means for registering both the unique coordinate location identification data and the sequential occurrence data of selected said encoded balls automatically upon the deposit of said encoded balls into the appropriate said receptacle on said console;

data encoding means for preparing said coordinate and sequential data for transmission;

means for transmitting said encoded coordinate and sequential data between said data encoding means and a receiver;

means for receiving and decoding said transmitted coordinate and sequential data into displayable information;

at least one display board for displaying said displayable information consisting of numerical digit indicating portions, which digit portions, when selected, are illuminated in both a coordinate location order portion of said at least one display board, and in a sequential order of selection portion of said at least one display board; and means for selectively activating multiple light bulb portions of said at least one display board, said light bulb portions revealing, when lighted, patterns which correspond with the numerical digits represented by said decoded coordinate and sequential data.

2. The device of claim 1 wherein said at least one display board is comprised of five rows, labeled "B", "I", "N", "G", "O", and one row labeled "SEQ", of fifteen columns of numerical digit indicating portions comprised of the numerals 01 to 75, inclusive.

3. The device of claim 1 wherein said transmitting means comprises the use of the modulated current of the electrical wiring system of the building wherein said device is located as signal carrying media between said data encoding means and said receiving means.

4. The device of claim 1 wherein said transmitting means comprises direct connection of coaxial cable as signal carrying media between said data encoding means and said receiving means.

5. The device of claim 1 wherein said transmitting means comprises direct connection of fiber-optic cable as signal carrying media between said data-encoding means and said receiving means.

6. The device of claim 1 wherein said transmitting means comprises the use of wireless radio transmission as signal carrying media.

7. The device of claim 1 wherein said transmitting means comprises the use of infra-red light as signal carrying media.

8. The device of claim 1 wherein said transmitting means comprises the use of laser light as signal carrying media.

9. The device of claim 1 wherein said means for automatically registering said coordinate and sequential data comprises a plurality of infra-red light emitter-receiver sets.

10. The device of claim 1 wherein said means for automatically registering said coordinate and sequential data comprises a plurality of mechanically operated electrical switches.

11. The device of claim 1 wherein said means for automatically registering said coordinate and sequential data comprises a plurality of proximity operated electronic switches.

12. The device of claim 1 wherein said means for marking and reading said balls comprises specially shaped characters imprinted on said balls, together with an Optical Character Reader apparatus.

13. The device of claim 1 wherein said means for marking and reading said balls comprises the use of magnetic ink to imprint characters on said balls, together with a Magnetic Ink Character Reader apparatus.

14. The device of claim 1 wherein said means for marking and reading said balls comprises the use of ordinary contrast-distinctive markings on said balls, together with the use of a scanner.

15. The device of claim 1 wherein the means of randomly selecting said encoded balls comprises the use of a device commonly known as a blower to agitate and impartially isolate one individual such ball.

16. The device of claim 1 wherein said at least one display board is not labelled with row and column identifiers.

17. The device of claim 16 wherein said at least one display board is arranged in six rows of ten numbers each, and contains a dividing spacer between the third and fourth rows.

18. A game-playing system and devices, comprising:

a plurality of light weight balls encoded with row and column coordinate location figures imprinted thereon;

means for randomly and automatically isolating and selecting one individual ball of said encoded balls;

an operator's console fitted with a plurality of receptacles uniquely identified by said row-column coordinates and provided for the receiving of said encoded balls, said uniquely identified receptacles corresponding to matching markings on said encoded balls;

means for registering both the unique coordinate location identification and the sequential occurrence data of selected said encoded balls automatically upon the deposit of said encoded balls into the appropriate said receptacle on said console;

data-encoding means for preparing said coordinate and sequential data for transmission;

means for transmitting said encoded coordinate and sequential data between said data encoding means and a receiver;

means for receiving and decoding said transmitted coordinate and sequential data into displayable information;

at least one display board for displaying said displayable information consisting of patterns of lights arranged so as to represent numerical digits, which digital patterns, when selected, are illuminated in both a numerical order portion of said at least one display board, and in a sequential order of selection portion of said at least one display board; and means for selectively activating multiple light bulb portions of said at least one display board, said light bulb portions revealing, when lighted, patterns which correspond with the numerical digits represented by said decoded coordinate and sequential data.

19. The device of claim 1 wherein said means for registering said coordinate location and sequential occurrence data for selected balls and said means for transmitting said data comprises a computer and associated keyboard, together with appropriate interface means for effecting satisfactory interfaces with other devices and circuits.

20. The device of claim 18 wherein said means for registering said coordinate location and sequential occurrence data for selected balls and said means for transmitting said data comprises a computer and associated keyboard, together with appropriate interface means for effecting satisfactory interfaces with other devices and circuits.

* * * * *